US011661311B2

(12) United States Patent
Pahlke

(10) Patent No.: US 11,661,311 B2
(45) Date of Patent: May 30, 2023

(54) ELEVATOR SYSTEM

(71) Applicant: Otis Elevator Company, Farmington, CT (US)

(72) Inventor: Derk Pahlke, Berlin (DE)

(73) Assignee: OTIS ELEVATOR COMPANY, Farmington, CT (US)

( * ) Notice: Subject to any disclaimer, the term of this patent is extended or adjusted under 35 U.S.C. 154(b) by 861 days.

(21) Appl. No.: 16/584,294

(22) Filed: Sep. 26, 2019

(65) Prior Publication Data

US 2020/0102187 A1 Apr. 2, 2020

(30) Foreign Application Priority Data

Sep. 27, 2018 (EP) ..... 18197166

(51) Int. Cl.

| | |
|---|---|
| ***B66B 1/46*** | (2006.01) |
| ***B66B 5/00*** | (2006.01) |
| ***B66B 1/28*** | (2006.01) |

(52) U.S. Cl.

CPC ..... *B66B 5/0012* (2013.01); *B66B 1/28* (2013.01); *B66B 1/468* (2013.01); *B66B 2201/103* (2013.01); *B66B 2201/4615* (2013.01)

(58) Field of Classification Search

CPC ..... B66B 5/0012; B66B 1/468; B66B 1/3492; B66B 5/0006; B66B 2201/222; B66B 2201/403; B66B 2201/4669; B66B 29/005; B66B 2201/4607; B66B 1/46

See application file for complete search history.

(56) References Cited

U.S. PATENT DOCUMENTS

| | | | |
|---|---|---|---|
| 5,258,586 | A | 11/1993 | Suzuki et al. |
| 5,569,888 | A | 10/1996 | Kamani et al. |
| 7,031,525 | B2 | 4/2006 | Beardsley |
| 7,692,684 | B2 | 4/2010 | Ku et al. |
| 7,958,971 | B2 | 6/2011 | Mangini et al. |
| 8,253,792 | B2 | 8/2012 | Wells et al. |
| 8,260,042 | B2 | 9/2012 | Peng et al. |
| 9,183,432 | B2 | 11/2015 | Sasatani et al. |
| 10,045,004 | B2 | 8/2018 | Hsu et al. |
| 2017/0291792 | A1 | 10/2017 | Scoville et al. |
| 2019/0023529 | A1* | 1/2019 | Lau ..... B66B 5/14 |

(Continued)

FOREIGN PATENT DOCUMENTS

| | | |
|---|---|---|
| CN | 102762478 A | 10/2012 |
| CN | 105129553 A | 12/2015 |

(Continued)

OTHER PUBLICATIONS

European Search Report for application EP 18197166.4, dated Apr. 15, 2019, 10 pages.

*Primary Examiner* — Marlon T Fletcher
(74) *Attorney, Agent, or Firm* — Cantor Colburn LLP

(57) ABSTRACT

An elevator system (2) comprises an elevator car (10) configured for traveling along a hoistway (4) between a plurality of landings (8); and at least one passenger sensor (20) provided at least one of the landings (8). The at least one passenger sensor (20) is configured for detecting passengers (26) being present within a predefined detection zone (28) at the respective landing (8) by detecting a detection signal (30b) reflected by a reflecting building structure (22, 24) of the respective landing (8), and for providing a corresponding sensor signal.

13 Claims, 2 Drawing Sheets

(56) References Cited

U.S. PATENT DOCUMENTS

| | | | | |
|---|---|---|---|---|
| 2020/0102187 | A1* | 4/2020 | Pahlke | B66B 5/0012 |
| 2021/0362978 | A1* | 11/2021 | Stranieri | B66B 5/0012 |

FOREIGN PATENT DOCUMENTS

| | | | | | |
|---|---|---|---|---|---|
| CN | 106809708 | A | | 6/2017 | |
| EP | 1345445 | A1 | | 9/2003 | |
| EP | 1345445 | A1 | * | 9/2003 | B66B 1/3476 |
| EP | 2093181 | A1 | | 8/2009 | |
| EP | 1509471 | B1 | * | 4/2011 | B66B 1/2458 |
| EP | 1779326 | B1 | | 1/2013 | |
| EP | 2953878 | A1 | | 12/2015 | |
| EP | 3075693 | A1 | | 10/2016 | |
| EP | 3075694 | A1 | * | 10/2016 | B66B 1/2408 |
| EP | 3075695 | A1 | * | 10/2016 | B66B 1/2408 |
| EP | 3075695 | A1 | | 10/2016 | |
| EP | 3075696 | A1 | * | 10/2016 | B66B 1/3461 |
| EP | 3075696 | A1 | | 10/2016 | |
| EP | 3075697 | A1 | | 10/2016 | |
| EP | 3075699 | A1 | | 10/2016 | |
| EP | 3106416 | A1 | | 12/2016 | |
| EP | 3192763 | A1 | | 7/2017 | |
| EP | 3243783 | A1 | | 11/2017 | |
| EP | 3312124 | A1 | | 4/2018 | |
| EP | 3628619 | A1 | * | 4/2020 | B66B 1/28 |
| EP | 3628620 | A1 | * | 4/2020 | B66B 1/28 |
| JP | S6296294 | A | | 5/1987 | |
| JP | 2000118896 | A | | 4/2000 | |
| JP | 2006076737 | A | * | 3/2006 | |
| JP | 2014159325 | A | | 4/2014 | |
| JP | 6377795 | B1 | * | 8/2018 | B66B 13/26 |
| JP | 2019167199 | A | * | 10/2019 | B66B 1/20 |
| JP | 2019210136 | A | * | 12/2019 | B66B 1/2408 |
| WO | 2006137319 | A1 | | 12/2006 | |
| WO | WO-2014108601 | A1 | * | 7/2014 | B66B 1/3492 |
| WO | WO-2016097241 | A1 | * | 6/2016 | B66B 11/00 |

* cited by examiner

ELEVATOR SYSTEM

FOREIGN PRIORITY

This application claims priority to European Patent Application No. 18197166.4 filed Sep. 27, 2018, and all the benefits accruing therefrom under 35 U.S.C. § 119, the contents of which in its entirety are herein incorporated by reference.

BACKGROUND

The invention relates to an elevator system, in particular to an elevator system comprising at least one passenger sensor provided at least one of its landings.

An elevator system typically comprises at least one elevator car moving between a plurality of landings and landing control panels allowing passengers to enter their hall calls or destination calls for using the elevator system.

The landing control panels may be destination control panels inviting the passengers to enter their desired destination landing in order to allow the elevator system to optimize the transportation of the passengers, in particular if the elevator system comprises a plurality of elevator cars.

In case a group of passengers desires to use the elevator system together, usually only a single destination call is input via the landing control panel.

In order to allow the elevator system to optimize the transportation of groups of passengers, it would be beneficial to allow the elevator system to determine the size of a group entering a destination call in order to be able to control the elevator system accordingly. An optimized control in particular may include sending an elevator car having enough free space for accommodating all members of the group to the respective landing.

SUMMARY

Exemplary embodiments of the invention include an elevator system comprising an elevator car configured for traveling along a hoistway between a plurality of landings and at least one passenger sensor provided at least one of the landings. The at least one passenger sensor is configured for detecting passengers, i.e. one or more passengers, which are present within a detection zone defined at the respective landing, by detecting a detection signal reflected by a reflecting building structure at the respective landing. The at least one passenger sensor is further configured for providing a sensor signal related to the detected passengers.

It has turned out that using a detection signal, which has been reflected by a reflecting building structure of the respective landing, is beneficial for determining the number of passengers within a detection zone defined at a landing, particularly in front of a landing control panel. In particular, the risk that some of the passengers are not detected by the passenger sensor since they are covered by other passengers so that the detection signal is blocked, which would result in an erroneous sensor signal, is minimized Thus, a sensor configured for providing a signal which is correlated with the number of passengers, i.e. a signal providing a measure of the number of passengers, at a landing can conveniently be arranged in or at an input terminal ("destination entry kiosks") housing the respective landing control panel. It in particular is not necessary to modify the building structure for installing the sensor.

Exemplary embodiments of the invention further include a method of controlling an elevator system according to an exemplary embodiment of the invention, wherein the method includes controlling the movement of the at least one elevator car based on the sensor signal(s) provided by the at least one passenger sensor.

This allows controlling the elevator system based on destination calls entered at the landings in combination with considering the number of passengers associated with each of the entered destination calls in order to ensure that every elevator car assigned to a passenger or to a group of passengers has enough free space for accommodating all passengers assigned to said elevator car. This avoids a situation in which not all passengers assigned to a certain elevator car can enter said elevator car due to overload. Such a situation would severely compromise the advantages of using destination calls for controlling the elevator system and dispatching the elevator cars. . . . The elevator control may employ a certain buffer between the number of passengers assigned to an elevator car and the actual maximum load of the elevator car in order to avoid an overload in case not all passengers associated with a destination call are detected by the at least one passenger sensor.

A number of optional features are set out in the following. These features may be realized in particular embodiments, alone or in combination with any of the other features, unless specified otherwise.

The reflecting building structure may be located in an upper part of the respective landing. The reflecting building structure in particular may include a ceiling or a portion of a ceiling of the respective landing. Optionally, a reflector may be provided at the ceiling of the respective landing.

Using a reflecting building structure located in an upper part of the respective landing, i.e. above the passengers being present at the respective landing, reduces the risk that some of the passengers are not detected by the passenger sensor since they are shadowed/covered by other passengers.

Using the ceiling of the landing for reflecting the signals allows for an easy implementation at low costs. Using a dedicated reflector might enhance the quality and/or intensity of the reflection. This might enhance the reliability of the detection and/or allow using cheaper passenger sensors with reduced sensitivity.

The at least one passenger sensor may be configured for providing a signal which is correlated with the number of passengers present within the predefined detection zone. In other words, the at least one passenger sensor may be configured for providing a signal which is a measure of the number of passengers present within the predefined detection zone. The predefined detection zone may be located close to the landing control panel at the respective landing in order to identify and count only passengers related to a control command (destination call) currently input via the landing control panel.

The at least one passenger sensor may comprise at least one detector (passive device) which is configured for detecting radiation emitted by the passengers and being reflected by the reflecting building structure. Detecting radiation, such as heat or noise, emitted by the passengers allows for a low cost implementation, as there is no need of providing an emitter for emitting radiation which is to be reflected by the passengers.

Alternatively, the at least one passenger sensor may comprise at least one emitter (active device) configured for emitting a detection signal to be reflected by the reflecting building structure towards the predefined detection zone, and at least one detector configured for detecting a detection signal reflected from at least one of the passengers within the predefined detection zone via the reflecting building structure towards the detector. The emitter may be configured for emitting the radiation towards the reflecting building structure within a well-defined opening angle centered around a defined emission direction.

Using an emitter allows using a detection signal comprising radiation which is not emitted by the passengers themselves. In particular, signals in a selected frequency range, which allows for a very reliable detection of the passengers, may be used.

The detection signal may include electromagnetic radiation, such as visible light, infrared light and/or millimeter waves. The sensor signal also may include sound, such as ultrasound.

The at least one emitter and/or the at least one detector may be arranged at or in an input terminal, such as a destination entry kiosk, located at the respective landing and housing the respective landing control panel. The at least one emitter and/or the at least one detector in particular may be arranged at or in the same input terminal.

The at least one emitter and/or the at least one detector may have an opening angle, i.e. an angle in which the detection signal is emitted and/or received, which is in the range of 30° to 60°, in particular an opening angle of 45°. By modifying the opening angle of the detector, the size of the detection zone may be adjusted. The size of the detection zone in particular may be adjusted in order to detect substantially all passengers belonging to a group of passengers entering a destination call without detecting additional passengers, which are not part of said group.

The elevator system may comprise a controller, in particular a controller which is configured for destination dispatching. When destination dispatching is applied, passengers enter their desired destinations via the landing control panels before entering an elevator car. The controller then assigns each passenger or each group of passengers to a dedicated elevator car in order to optimize the transport capacity and the transport speed of the elevator system. In particular, passengers with the same destination may be assigned to the same elevator car for reducing the total number of stops of the elevator cars.

A method of controlling an elevator system in particular may include receiving a destination call at one of the landings; determining a measure of the number of passengers being present within the predefined detection zone at the respective landing from a sensor signal provided by a passenger sensor located at said landing; and controlling the movement of the at least one elevator car based on the received destination call and the determined measure of the number of passengers.

Destination dispatching using a sensor signal indicating a measure of the number of passengers associated with a currently entered destination call allows for a very efficient control of the elevator system; it in particular allows for an efficient dispatching of the elevator car(s) in response to hall calls or destination calls.

DRAWING DESCRIPTION

In the following, exemplary embodiments of the invention are described in more detail with respect to the enclosed figures:

FIG. 1 schematically depicts an elevator system to which an exemplary embodiment of the present invention may be applied.

DETAILED DESCRIPTION

Figure 1:
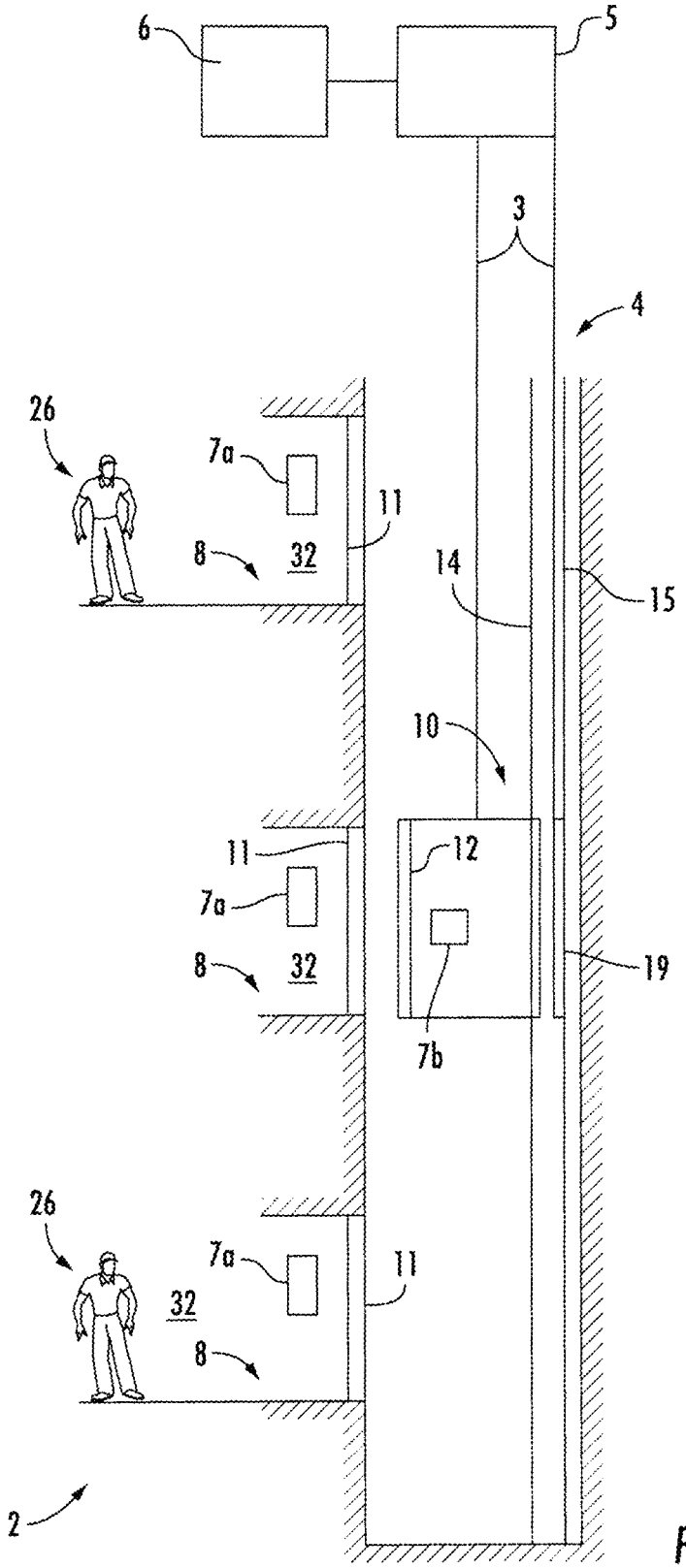

FIG. 1 schematically depicts an elevator system 2 to which an exemplary embodiment of the present invention may be applied.

The elevator system 2 includes an elevator car 10 movably arranged within a hoistway 4 extending between a plurality of landings 8. The elevator car 10 in particular is movable along a plurality of car guide members 14, such as guide rails, extending along the vertical direction of the hoistway 4. Only one of said car guide members 14 is visible in FIG. 1.

Although only one elevator car 10 is depicted in FIG. 1, the skilled person will understand that exemplary embodiments of the invention may include elevator systems 2 having a plurality of elevator cars 10 moving in one or more hoistways 4.

The elevator car 10 is movably suspended by means of a tension member 3. The tension member 3, for example a rope or belt, is connected to a drive unit 5, which is configured for driving the tension member 3 in order to move the elevator car 10 along the height of the hoistway 4 between the plurality of landings 8, which are located on different floors.

Each landing 8 is provided with a landing door 11, and the elevator car 10 is provided with a corresponding elevator car door 12 for allowing passengers to transfer between a landing 8 and the interior of the elevator car 10 when the elevator car 10 is positioned at the respective landing 8.

The exemplary embodiment of the elevator system 2 shown in FIG. 1 employs a 1:1 roping for suspending the elevator car 10. The skilled person, however, easily understands that the type of the roping is not essential for the invention and that different kinds of roping, e.g. a 2:1 roping, may be used as well. The elevator system 2 may have a machine room or may be a machine room-less elevator system. The elevator system 2 may use a tension member 3, as it is shown in FIG. 1, or it may be an elevator system without a tension member 3. The drive 5 may be any form of drive used in the art, e.g. a traction drive, a hydraulic drive or a linear drive.

The elevator system 2 shown in FIG. 1 further includes a counterweight 19 attached to the tension member 3 and moving concurrently and in opposite direction with respect to the elevator car 10 along at least one counterweight guide member 15. The skilled person will understand that the invention may be applied also to elevator systems 2 which do not comprise a counterweight 19.

The tension member 3 may be a rope, e.g. a steel wire rope, or a belt. The tension member 3 may be uncoated or may have a coating, e.g. in the form of a polymer jacket. In a particular embodiment, the tension member 3 may be a belt comprising a plurality of polymer coated steel cords (not shown). The elevator system 2 may have a traction drive including a traction sheave for driving the tension member 3.

The drive unit 5 is controlled by a controller 6 for moving the elevator car 10 along the hoistway 4 between the different landings 8.

Input to the controller 6 may be provided via landing control panels 7*a*, which are provided on each landing 8 close to the landing doors 11, and/or via an elevator car control panel 7*b*, which is provided inside the elevator car 10.

The controller 6 in particular may be configured for destination dispatching. When destination dispatching is applied, passengers 26 enter their desired destinations via the landing control panels 7*a* before entering an elevator car 10. The controller 6 than assigns each passenger 26 to a dedicated elevator car 10 for optimizing the transport capacity and the transport speed of the elevator system 2. In particular, passengers 26 with the same destination may be assigned to the same elevator car 10 for reducing the total number of stops of the elevator cars 10. When destination dispatching is applied, usually no elevator car control panel 7*b* is used.

Each of the landing control panels 7*a* may be mounted to a wall 32 at the respective landing 8. Alternatively, the landing control panels 7*a* may be located in input terminals 34 (see FIG. 3) arranged in the vicinity of the respective landing doors 11. The input terminals 34 in particular may be freestanding destination entry kiosks arranged in front of the landing doors 11.

The landing control panels 7*a* and the elevator car control panel 7*b* may be connected to the controller 6 by means of electric wires, which are not shown in FIG. 1, in particular by an electric bus, such as a field bus/CAN-bus, or by means of wireless data connections.

Figure 2:
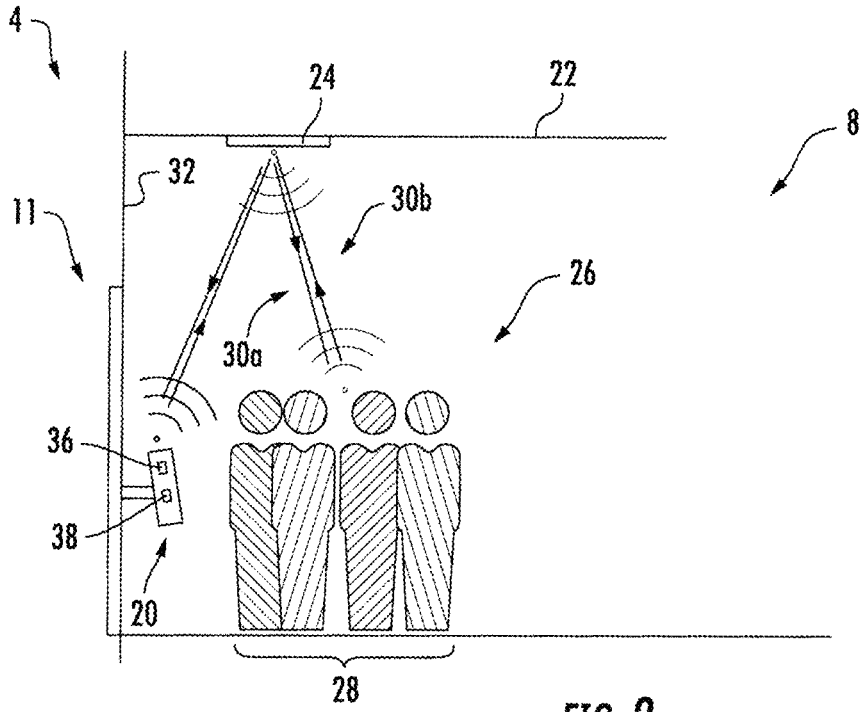
FIG. 2 shows a schematic side view of a landing of an elevator system in which an exemplary embodiment of the present invention is employed.
Figure 3:
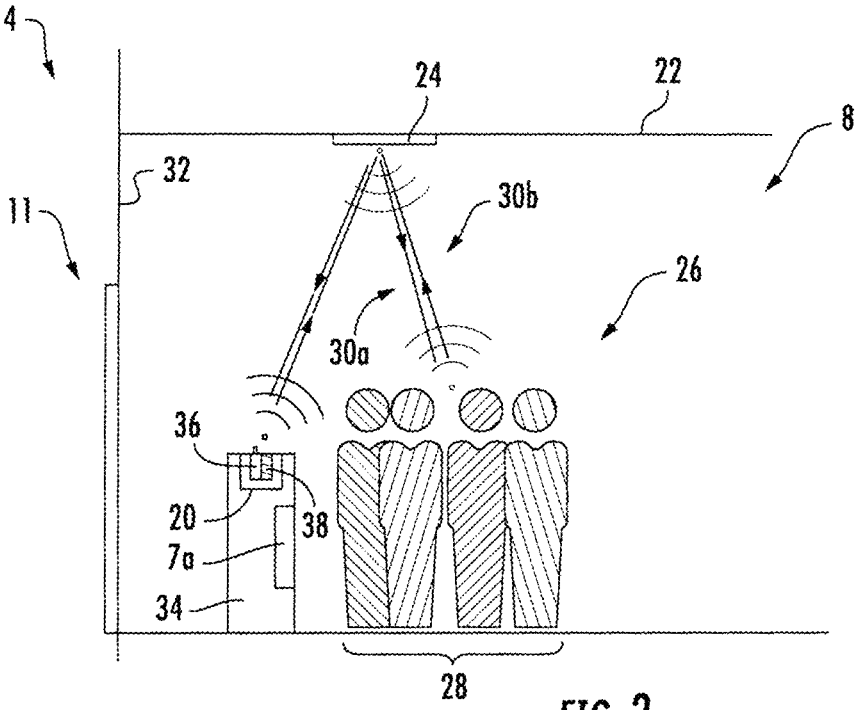
FIG. 3 shows a schematic side view of a landing of an elevator system in which another exemplary embodiment of the present invention is employed.

FIGS. 2 and 3 respectively depict a schematic side view of a landing 8 of an elevator system 2 in which an embodiment of the present invention is employed. The landing 8 may be any landing 8 of the elevator system 2. The landing 8 in particular may be a landing 8 located in the lobby of the building housing the elevator system 2, or any other landing 8 for which a large passenger traffic is expected.

At least one passenger sensor 20 is provided at the landing 8. The at least one passenger sensor is configured for detecting passengers 26 which are present within a detection zone 28 defined at the landing 8 by detecting a detection signal 30*b* reflected by a reflecting building structure 22, 24, such as a ceiling 22 of the landing 8. The at least one passenger sensor 20 in particular is configured for providing a sensor signal which is a measure of the number of passengers 26 detected within the detection zone 28.

Optionally, the reflecting building structure 22, 24 may include a reflector 24 and/or a reflective coating, in order to enhance the reflection properties of the reflecting building structure 22, 24.

Using a reflected detection signal 30*b* for detecting the passengers 26, reduces or minimizes the risk of generating a wrong sensor signal because passengers 26 are not detected since they are shadowed by other passengers 26 so that the detection signal 30*b* is blocked.

As a result, the elevator system 2 may be controlled based on the number of detected passengers 26 in combination with a destination call entered at the respective landing 8 in order to optimize the transport capacity of the elevator system 2 and the user experience of the passengers 26. In particular, only elevator cars 10 having enough free space for accommodating the whole group of passengers 26 standing within the detection zone 28 may stop at the landing 8 in order to avoid that the passengers 26 need to separate for entering different elevator cars 10.

The at least one passenger sensor 20 may be mounted to a wall 32 at the landing 8, as shown in FIG. 2. The at least one passenger sensor 20 may be located at or within an input terminal 34, which comprises the landing control panel 7 and is arranged at the landing 8 in the vicinity of the landing door 11, as it is shown in FIG. 3.

The at least one passenger sensor 20 may comprise at least one detector 36 configured for detecting radiation such as heat or noise emitted by the passengers 26 and being reflected by the structural component 22 or the reflector 24.

The at least one passenger sensor 20 may further comprise at least one emitter 38 configured for emitting a detection signal 30*a* to be reflected by the reflecting building structure 22, 24 towards the predefined detection zone 28 and the at least one detector 36 may be configured for detecting a detection signal 30*b* reflected from at least one of the passengers 26 within the predefined detection zone 28.

The at least one emitter 38 and/or the at least one detector 36 may have an opening angle in the range of 30° to 60°, in particular an opening angle of 45°. By modifying the opening angle of the detector 36, the size of the detection zone 28 may be adjusted in order to detect preferably all passengers 26 of a group of passengers 26 entering a destination call without detecting additional passenger 26 which are not part of the group.

The detection signal 30*a*, 30*b* which is emitted by the at least one emitter 38 and/or detected by the at least one detector 36 may include electromagnetic radiation, in particular at least one of visible light, infrared light and millimeter waves.

The detection signal 30*a*, 30*b* emitted by the at least one emitter 38 and/or detected by the at least one detector 36 may also include sound, in particular ultrasound and/or sound generated by the passengers 26 within the detection zone 28.

While the invention has been described with reference to exemplary embodiments, it will be understood by those skilled in the art that various changes may be made and equivalents may be substituted for elements thereof without departing from the scope of the invention. In addition, many modifications may be made to adopt a particular situation or material to the teachings of the invention without departing from the essential scope thereof. Therefore, it is intended that the invention shall not be limited to the particular embodiment disclosed, but that the invention includes all embodiments falling within the scope of the dependent claims.

REFERENCES

2 elevator system
3 tension member
4 hoistway
5 drive unit
6 controller
7*a* landing control panel
7*b* elevator car control panel
8 landing
10 elevator car
11 landing door
12 elevator car door
14 car guide member
15 counterweight guide member
17 braking member
19 counterweight
20 passenger sensor
22 reflecting building structure/ceiling
24 reflecting building structure/reflector
26 passengers
28 detection zone

30*a* emitted detection signal
30*b* detected detection signal
32 wall
34 input terminal
36 detector
38 emitter

What is claimed is:

1. Elevator system (2) comprising:

an elevator car (10) configured for traveling along a hoistway (4) between a plurality of landings (8); and at least one passenger sensor (20) provided at at least one of the landings (8);

wherein the at least one passenger sensor (20) is configured for detecting passengers (26) being present within a detection zone (28) defined at the respective landing (8) by detecting a detection signal (30*b*) reflected by a reflecting building structure (22, 24) at the respective landing (8), and for providing a corresponding sensor signal;

wherein the at least one passenger sensor (20) comprises at least one emitter (38) configured for emitting a detection signal (30*a*) to be reflected by the ceiling (22) towards the predefined detection zone (28), and at least one detector (36) configured for detecting a detection signal (30*b*) reflected from at least one of the passengers (26) within the predefined detection zone (28) via the ceiling (22) towards the detector (36).

2. Elevator system (2) according to claim 1, wherein the reflecting building structure (22, 24) is located at an upper part of the respective landing (8).

3. Elevator system (2) according to claim 2, wherein the reflecting building structure (22, 24) is a ceiling (22) of the respective landing (8) or a reflector (24) provided at the ceiling (22) of the respective landing (8).

4. Elevator system (2) according to claim 1, wherein the at least one passenger sensor (20) is configured for providing a signal which is a measure of the number of passengers (26) being present within the predefined detection zone (28).

5. Elevator system (2) according to claim 1, wherein the at least one detector (36) has an opening angle in between 30° and 60°, in particular an opening angle of 45°.

6. Elevator system (2) according to claim 1, wherein the at least one emitter (38) has an opening angle in between 30° and 60°, in particular an opening angle of 45°.

7. Elevator system (2) according to claim 1, wherein the emitted and/or detected detection signal (30*a*, 30*b*) includes electromagnetic radiation, in particular visible and/or infrared light.

8. Elevator system (2) according to claim 1, wherein the emitted and/or detected detection signal (30*a*, 30*b*) includes sound, in particular ultrasound and/or sound generated by the passengers (26) being present within the detection zone (28).

9. Elevator system (2) according to claim 1, further comprising an input terminal (34) located at at least one of the landings (8), wherein the at least one passenger sensor (20) is located at or within the at least one input terminal (34).

10. Elevator system (2) according to claim 1 comprising a controller (6) configured for controlling the movement of the at least one elevator car (10) based on the sensor signal(s) provided by the at least one passenger sensor (20).

11. Elevator system (2) according to claim 10, wherein the controller (6) is configured for destination dispatching.

12. Method of controlling an elevator system (2) according to claim 1, wherein the method includes controlling the movement of the at least one elevator car (10) based on the sensor signal(s) provided by the at least one passenger sensor (20).

13. Method of controlling an elevator system (2) according to claim 11, wherein the method includes receiving a destination call at one of the landings (8);

determining a measure of the number of passengers (26) being present within the predefined detection zone (28) at the respective landing (8) from a sensor signal provided by a passenger sensor (20) located at said landing (8); and controlling the movement of the at least one elevator car (10) based on the received destination call and the determined a measure of number of passengers (26).

* * * * *